US009899132B2

(12) United States Patent
Gilmore

(10) Patent No.: US 9,899,132 B2
(45) Date of Patent: Feb. 20, 2018

(54) MAGNETICALLY LATCHING TWO POSITION ACTUATOR AND A CLUTCHED DEVICE HAVING A MAGNETICALLY LATCHING TWO POSITION ACTUATOR

(71) Applicant: American Axle & Manufacturing, Inc., Detroit, MI (US)

(72) Inventor: Curt D. Gilmore, Fenton, MI (US)

(73) Assignee: American Axle & Manufacturing, Inc., Detroit, MI (US)

( * ) Notice: Subject to any disclaimer, the term of this patent is extended or adjusted under 35 U.S.C. 154(b) by 0 days.

(21) Appl. No.: 15/270,035

(22) Filed: Sep. 20, 2016

(65) Prior Publication Data

US 2017/0011834 A1 Jan. 12, 2017

Related U.S. Application Data

(63) Continuation of application No. 14/606,096, filed on Jan. 27, 2015, now Pat. No. 9,478,339.

(51) Int. Cl.

| | |
|---|---|
| ***H01F 7/00*** | (2006.01) |
| ***H01F 7/16*** | (2006.01) |
| ***H01F 7/122*** | (2006.01) |
| *H01F 7/08* | (2006.01) |

(52) U.S. Cl.

CPC ..... *H01F 7/1615* (2013.01); *H01F 7/122* (2013.01); *H01F 2007/086* (2013.01); *H01F 2007/1669* (2013.01); *H01F 2007/1692* (2013.01)

(58) Field of Classification Search

CPC ..... H01F 7/122; H01F 7/1615; F01L 9/04; H01L 2009/0405

USPC ..... 335/229, 256

See application file for complete search history.

(56) References Cited

U.S. PATENT DOCUMENTS

| | | | | |
|---|---|---|---|---|
| 3,202,886 | A * | 8/1965 | Kramer | H01F 7/1615 310/14 |
| 3,460,081 | A | 8/1969 | Tillman | |
| 3,504,315 | A | 3/1970 | Stanwell | |
| 3,634,735 | A | 1/1972 | Komatsu | |
| 3,728,654 | A | 4/1973 | Tada | |
| 3,980,908 | A * | 9/1976 | McClintock | G03B 7/083 264/101 |
| 4,422,060 | A * | 12/1983 | Matsumoto | H01F 7/13 335/234 |
| 4,494,098 | A * | 1/1985 | Haneda | H01F 7/1615 335/230 |

(Continued)

*Primary Examiner* — Alexander Talpalatski

(74) *Attorney, Agent, or Firm* — Harness, Dickey & Pierce, P.L.C.

(57) ABSTRACT

An actuator can include a housing, core assembly, and first and second electromagnets. The housing can have a first pole piece, second pole piece, and central pole piece disposed between the first and second pole pieces. The central pole piece can have a central body and a bridge. The bridge can be between the first and second pole pieces and axially movable relative thereto. The core assembly can be received in the housing. The core assembly can be movable along a first axis between a first core position and a second core position. The core assembly can include a permanent magnet, a first core, and a second core. The first and second cores can be coupled to the permanent magnet for common axial movement. The first and second electromagnets can be spaced axially apart by the central body and can have opposite polarities.

16 Claims, 7 Drawing Sheets

(56) References Cited

U.S. PATENT DOCUMENTS 4,533,890 A 8/1985 Patel
4,558,293 A * 12/1985 Haneda ..... H01F 7/1615 310/30
4,751,487 A 6/1988 Green, Jr.
4,779,582 A 10/1988 Lequesne
4,928,028 A * 5/1990 Leibovich ..... H01F 7/1646 310/23
5,039,967 A * 8/1991 Morishita ..... H01H 51/065 335/126
5,227,751 A * 7/1993 Shiroyama ..... F02N 15/066 335/126
5,420,413 A * 5/1995 Fields ..... G01D 5/34 250/214 PR
5,896,076 A * 4/1999 van Namen ..... H01F 7/1615 335/222
5,949,315 A * 9/1999 Kalb ..... H01H 51/2209 335/179
6,474,276 B1 * 11/2002 Schmitz ..... F01L 9/04 123/90.11
6,595,485 B2 * 7/2003 Burrola ..... F16K 31/0696 251/129.15
6,634,249 B2 10/2003 Yamamoto
6,701,876 B2 * 3/2004 Youqing ..... F01L 9/04 123/90.11
6,791,442 B1 * 9/2004 Schmidt ..... H01F 7/1615 335/220
6,819,208 B1 * 11/2004 Peghaire ..... F01L 9/04 251/129.01
7,036,469 B2 * 5/2006 Degner ..... F01L 9/04 123/90.11
7,038,564 B1 * 5/2006 Kusumoto ..... F02N 15/062 335/126
7,157,996 B2 * 1/2007 Enomoto ..... H01H 50/02 335/126
7,255,074 B2 * 8/2007 Han ..... F01L 9/04 123/90.11
7,573,361 B2 * 8/2009 Sakurai ..... H01F 7/1615 335/207
7,859,144 B1 * 12/2010 Sahyoun ..... H02K 33/16 310/14
8,344,832 B2 * 1/2013 Lee ..... H01H 51/065 335/126
8,579,250 B1 11/2013 Theobald
8,710,945 B2 * 4/2014 Wygnanski ..... H01F 7/1646 335/229
9,478,339 B2 * 10/2016 Gilmore ..... H01F 7/1615
2009/0114863 A1 * 5/2009 Nishida ..... F01L 9/04 251/129.15

* cited by examiner

MAGNETICALLY LATCHING TWO POSITION ACTUATOR AND A CLUTCHED DEVICE HAVING A MAGNETICALLY LATCHING TWO POSITION ACTUATOR

CROSS-REFERENCE TO RELATED APPLICATIONS

This application is a continuation of U.S. patent application Ser. No. 14/606,096 filed on Jan. 27, 2015. The entire disclosure of the above application is incorporated herein by reference.

FIELD

The present disclosure relates to a magnetically latching two position actuator and a clutched device having a magnetically latching two position actuator.

BACKGROUND

This section provides background information related to the present disclosure which is not necessarily prior art.

Clutched devices, such as power transmitting devices, transmissions, or suspension components for example, often require linear motion to translate one or more power transmitting elements, such as friction plates or shift forks for example, into or out of engagement positions. These engagement positions can selectively connect or disconnect a vehicle axle, such as switching between two and four-wheel (or all-wheel) drive modes for example. The engagement positions can alternatively switch between transmission gears, such as between low and high speed gear ratios for example, or can electronically disconnect suspension components, such as sway bars for example. Various types of linear actuators exist to create such linear motion, such as hydraulic rams, rack and pinion gearing, or solenoids for example. However, there remains a need in the art for an improved actuator for providing linear motion in clutched devices.

SUMMARY

This section provides a general summary of the disclosure, and is not a comprehensive disclosure of its full scope or all of its features.

The present teachings provide for an actuator including a housing, a core assembly, a first electromagnet, and a second electromagnet. The housing can have a first pole piece, a second pole piece, and a central pole piece disposed between the first and second pole pieces. The central pole piece can have a central body and a bridge. The bridge can have a first base, a second base, and a span that extends between the first and second bases. The core assembly can be received in the housing and can be movable along a first axis between a first core position and a second core position. The core assembly can include a permanent magnet, and first and second cores coupled for common axial movement with the permanent magnet and spaced axially apart by the permanent magnet. The first and second electromagnet can be spaced axially apart by the central pole piece and can have opposite polarities. The central pole piece can extend radially inward of an outermost portion of the first core and radially inward of an outer most portion of the second core. The central body can be axially between the first and second electromagnets. The first base can be radially inward of the first electromagnet and can axially overlap with a portion of the first electromagnet. The second base can be radially inward of the second electromagnet and can axially overlap with a portion of the second electromagnet.

The present teachings provide for an actuator including a housing, a core assembly, a first electromagnet and a second electromagnet. The housing can have a first pole piece, a second pole piece, and a central pole piece that can be disposed between the first and second pole pieces. The central pole piece can have a central body and a bridge. The bridge can be disposed between the first and second pole pieces and axially movable relative thereto. The core assembly can be received in the housing. The core assembly can be movable along a first axis between a first core position and a second core position. The core assembly can include a permanent magnet, a first core, and a second core. The first and second cores can be coupled to the permanent magnet for common axial movement. The first and second electromagnets can be spaced axially apart by the central body and can have opposite polarities.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
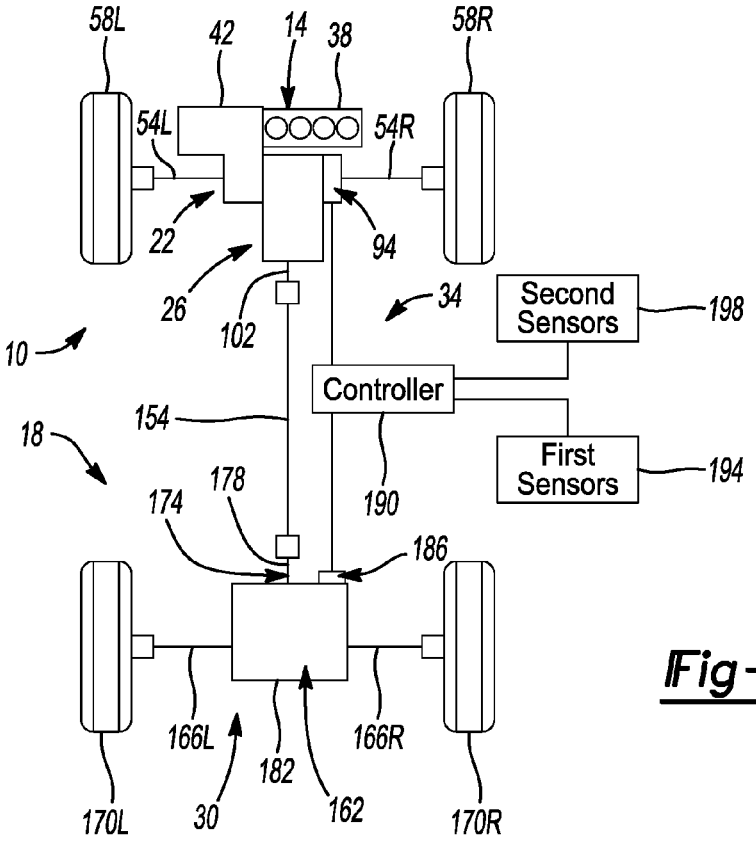
FIG. 1 is a schematic of a motor vehicle having a disconnectable all-wheel drive system with a clutched device constructed in accordance with the teachings of the present disclosure.
Figure 2:
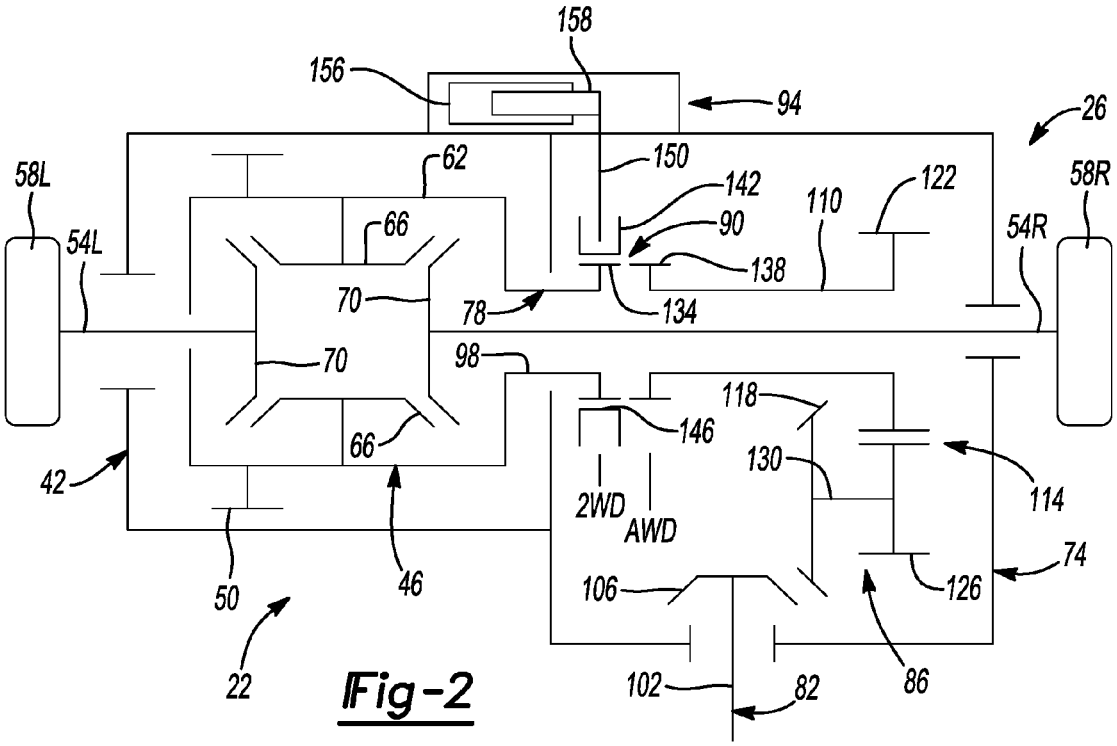
FIG. 2 is a schematic illustration of a portion of the motor vehicle of FIG. 1, illustrating the clutched device in more detail.

With reference to FIGS. 1 and 2 of the drawings, a motor vehicle constructed in accordance with the teachings of the present disclosure is schematically shown and generally indicated by reference numeral 10. The vehicle 10 can include a powertrain 14 and a drivetrain 18 that can include a primary driveline 22, a clutched device or power switching mechanism 26, a secondary driveline 30, and a control system 34. In the various aspects of the present teachings, the primary driveline 22 can be a front driveline while the secondary driveline 30 can be a rear driveline.

The powertrain 14 can include a prime mover 38, such as an internal combustion engine or an electric motor, and a transmission 42 which can be any type of ratio-changing mechanism, such as a manual, automatic, or continuously variable transmission. The prime mover 38 is operable to provide rotary power to the primary driveline 22 and the power switching mechanism 26.

The primary driveline 22 can include a primary or first differential 46 having an input member 50 driven by an output member (not shown) of the transmission 42. In the particular example shown, the first differential 46 is configured as part of the transmission 42, a type commonly referred to as a transaxle and typically used in front-wheel drive vehicles. The primary driveline 22 can further include a pair of first axleshafts 54L, 54R that can couple output components of the first differential 46 to a set of first vehicle wheels 58L, 58R. The first differential 46 can include a first differential case 62 that is rotatably driven by the input member 50, at least one pair of first pinion gears 66 rotatably driven by the first differential case 62, and a pair of first side gears 70. Each of the first side gears 70 can be meshed with the first pinion gears 66 and drivingly coupled to an associated one of the first axleshafts 54L, 54R.

The power switching mechanism 26, hereinafter referred to as a power take-off unit ("PTU"), can generally include a housing 74, an input 78 coupled for common rotation with the first differential case 62 of the first differential 46, an output 82, a transfer gear assembly 86, a disconnect mechanism 90, and a disconnect actuator 94. The input 78 can include a tubular input shaft 98 rotatably supported by the housing 74 and which concentrically surrounds a portion of the first axleshaft 54R. A first end of the input shaft 98 can be coupled for rotation with the first differential case 62. The output 82 can include an output pinion shaft 102 rotatably supported by the housing 74 and having a pinion gear 106. The transfer gear assembly 86 can include a hollow transfer shaft 110, a helical gearset 114, and a hypoid gear 118 that is meshed with the pinion gear 106. The transfer shaft 110 concentrically surrounds a portion of the first axleshaft 54R and is rotatably supported by the housing 74. The helical gearset 114 can include a first helical gear 122 fixed for rotation with the transfer shaft 110 and a second helical gear 126 which is meshed with the first helical gear 122. The second helical gear 126 and the hypoid gear 118 are integrally formed on, or fixed for common rotation with, a stub shaft 130 that is rotatably supported in the housing 74.

The disconnect mechanism 90 can comprise any type of clutch, disconnect or coupling device that can be employed to selectively transmit rotary power from the primary driveline 22 to the secondary driveline 30. In the particular example provided, the disconnect mechanism 90 comprises a clutch having a set of external spline teeth 134, which can be formed on a second end of the input shaft 98, a set of external clutch teeth 138, which can be formed on the transfer shaft 110, a mode collar 142 having internal spline teeth 146 constantly meshed with the external spline teeth 134 on the input shaft 98, and a shift fork 150 operable to axially translate the shift collar 142 between a first mode position and a second mode position. It will be appreciated that the clutch could include a synchronizer if such a configuration is desired.

The mode collar 142 is shown in FIG. 2 in its first mode position, identified by a "2WD" leadline, wherein the internal spline teeth 146 on the mode collar 142 are disengaged from the external clutch teeth 138 on the transfer shaft 110. As such, the input shaft 98 is disconnected from driven engagement with the transfer shaft 110. Thus, no rotary power is transmitted from the powertrain 14 to the transfer gear assembly 86 and the output pinion shaft 102 of the power take-off unit 26. With the mode collar 142 in its second mode position, identified by an "AWD" leadline, its internal spline teeth 146 are engaged with both the external spline teeth 134 on the input shaft 98 and the external clutch teeth 138 on the transfer shaft 110. Accordingly, the mode collar 142 establishes a drive connection between the input shaft 98 and the transfer shaft 110 such that rotary power from the powertrain 14 is transmitted through the power take-off unit 26 to the output pinion shaft 102. The output pinion shaft 102 is coupled via a propshaft 154 to the secondary driveline 30. The disconnect actuator 94 can include a housing 156 and a plunger 158 that is operable for axially, or linearly moving the shift fork 150 which, in turn, causes concurrent axial translation of the mode collar 142 between the first and second mode positions. The disconnect actuator 94 is shown mounted to the housing 74 of the PTU 26. The disconnect actuator 94 can be a power-operated mechanism that can receive control signals from the control system 34. The disconnect actuator 94 will be discussed in greater detail below, with regard to FIGS. 3-5.

The secondary driveline 30 can include the propshaft 154, a rear drive module ("RDM") 162, a pair of second axleshafts 166L, 166R, and a set of second vehicle wheels 170L, 170R. A first end of the propshaft 154 can be coupled for rotation with the output pinion shaft 102 extending from the power take-off unit 26 while a second end of the propshaft 154 can be coupled for rotation with an input 174 of the rear drive module 162. The input 174 can include input pinion shaft 178. The rear drive module 162 can be configured to transfer rotational input from input 174 to the drive axleshafts 166L, 166R. The rear drive module 162 can include, for example a housing 182, a secondary or second differential (not shown), a torque transfer device ("TTD") (not shown) that is generally configured and arranged to selectively couple and transmit rotary power from the input 174 to the second differential, and a TTD actuator 186. The second differential can be configured to drive the axleshafts 166L, 166R. The TTD can include any type of clutch or coupling device that can be employed to selectively transmit rotary power from the input 174 to the second differential, such as a multi-plate friction clutch for example. The TTD actuator 186 is provided to selectively engage and disengage the TTD, and can be controlled by control signals from the control system 34. The TTD actuator 186 can be any power-operated device capable of shifting the TTD between its first and second modes as well as adaptively regulating the magnitude of the clutch engagement force exerted.

The control system 34 is schematically shown in FIG. 1 to include a controller 190, a group of first sensors 194, and a group of second sensors 198. The group of first sensors 194 can be arranged within the motor vehicle 10 to sense a vehicle parameter and responsively generate a first sensor signal. The vehicle parameter can be associated with any combination of the following: vehicle speed, yaw rate, steering angle, engine torque, wheel speeds, shaft speeds, lateral acceleration, longitudinal acceleration, throttle position, position of shift fork 150, position of mode collar 142, position of plunger 158, and gear position without limitations thereto. The controller 190 can include a plunger displacement feedback loop that permits the controller 190 to accurately determine the position of the plunger 158 or of an element associated with the position of the plunger 158. The group of second sensors 198 can be configured to sense a driver-initiated input to one or more on-board devices and/or systems within the vehicle 10 and responsively generate a second sensor signal. For example, the motor vehicle 10 may be equipped with a sensor associated with a mode selection device, such as a switch associated with a push button or a lever, that senses when the vehicle operator has selected between vehicle operation in a two-wheel drive (FWD) mode and an all-wheel drive (AWD) mode. Also, switched actuation of vehicular systems such as the windshield wipers, the defroster, and/or the heating system, for example, may be used by the controller 190 to assess whether the motor vehicle 10 should be shifted automatically between the FWD and AWD modes.

The vehicle 10 can normally be operated in the two-wheel drive (FWD) mode in which the power take-off unit 26 and the rear drive module 162 are both disengaged. Specifically, the mode collar 142 of the disconnect mechanism 90 is positioned by the disconnect actuator 94 in its first (2WD) mode position such that the input shaft 98 is uncoupled from the transfer shaft 110. As such, substantially all power provided by the powertrain 14 is transmitted to the primary driveline 22. Likewise, the TTD can disconnected such that the input 174, the propshaft 154, the output pinion shaft 102 and the transfer gear assembly 86 within the power take-off unit 26 are not back-driven due to rolling movement of the second vehicle wheels 170L, 170R. While the actuator 94 is described herein with reference to positioning the mode collar 142 to selectively change modes of the power take off unit 26, the actuator 94 can be used on other clutched vehicle components such as other driveline components (not shown) or a suspension system (not shown), such as an electronically disconnecting sway bar for example.

When it is desired or necessary to operate the motor vehicle 10 in the all-wheel drive (AWD) mode, the control system 34 can be activated via a suitable input which, as noted, can include a driver requested input (via the mode select device) and/or an input generated by the controller 190 in response to signals from the first sensors 194 and/or the second sensors 198. The controller 190 initially signals the TTD actuator 186 to engage the TTD to couple the input 174 to the axleshafts 166L, 166R. Specifically, the controller 190 controls operation of the TTD actuator 186 such that the TTD is coupled sufficiently to synchronize the speed of the secondary driveline 30 with the speed of the primary driveline 22. Upon speed synchronization, the controller 190 signals the actuator 94 to cause the mode collar 142 in the power take-off unit 26 to move from its first mode position into its second mode position. With the mode collar 142 in its second mode position, rotary power is transmitted from the powertrain 14 to the primary driveline 22 and the secondary driveline 30. It will be appreciated that subsequent control of the magnitude of the clutch engagement force generated by the TTD permits torque biasing for controlling the torque distribution ratio transmitted from the powertrain 14 to the primary driveline 22 and the secondary driveline 30.

Figure 3:
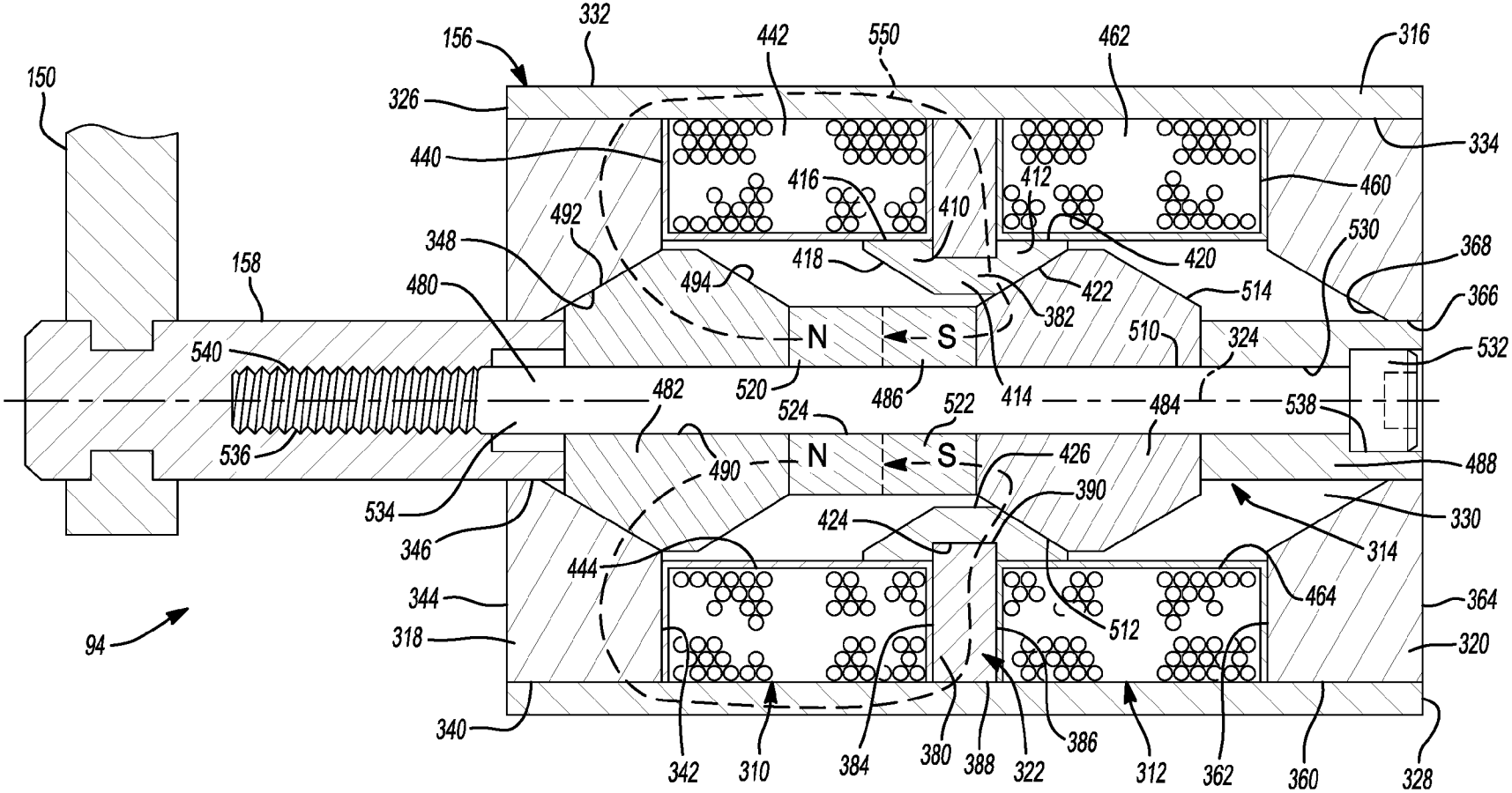
FIG. 3 is a cross-sectional view of a portion of the clutched device of FIG. 1, illustrating an actuator of the clutched device of a first construction in more detail.
Figure 4:
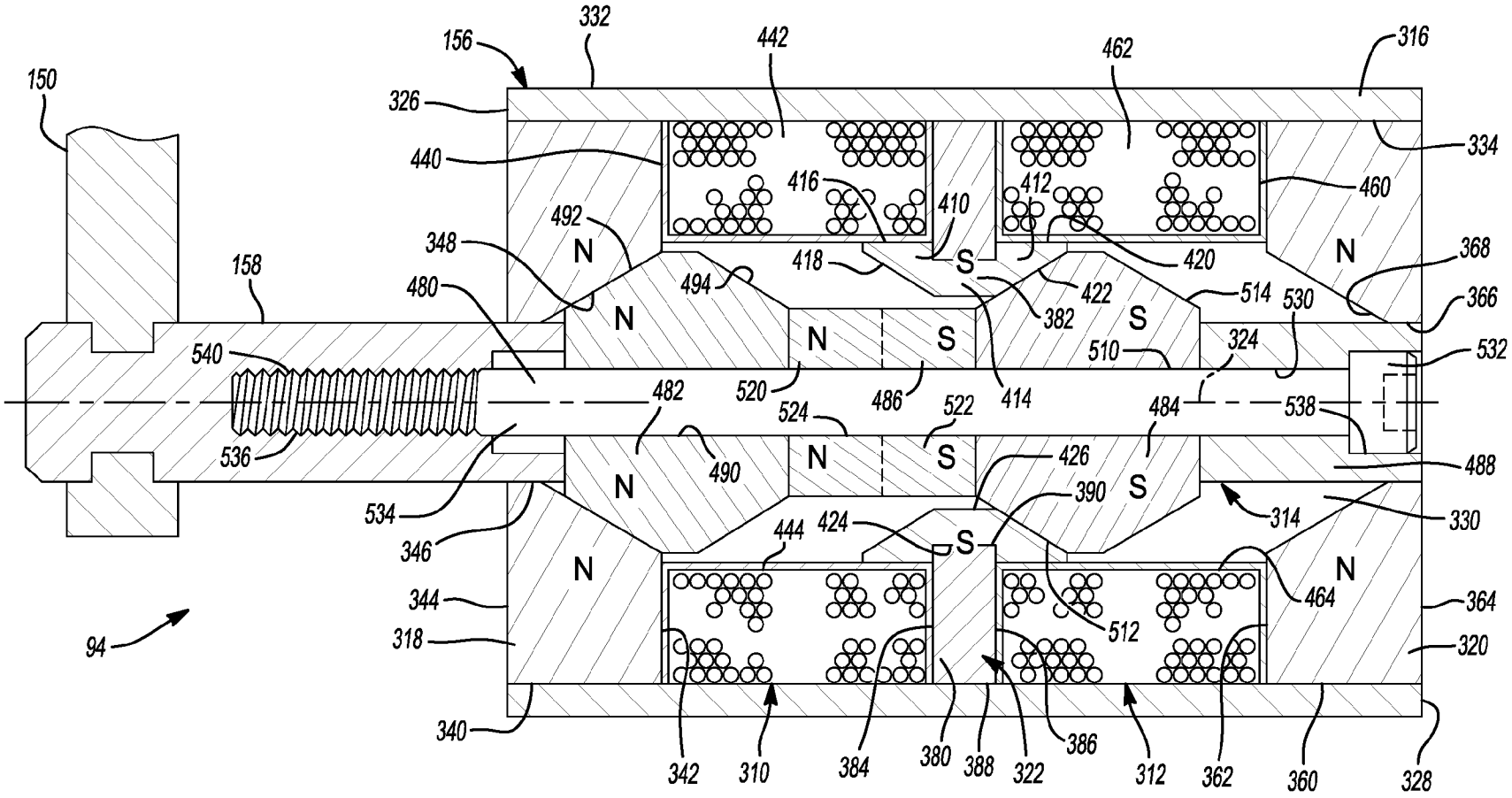
FIG. 4 is a cross-sectional view of the portion of the clutched device of FIG. 3, illustrating a plunger of the actuator in a first actuator position and an electromagnet of the actuator in an energized state.
Figure 5:
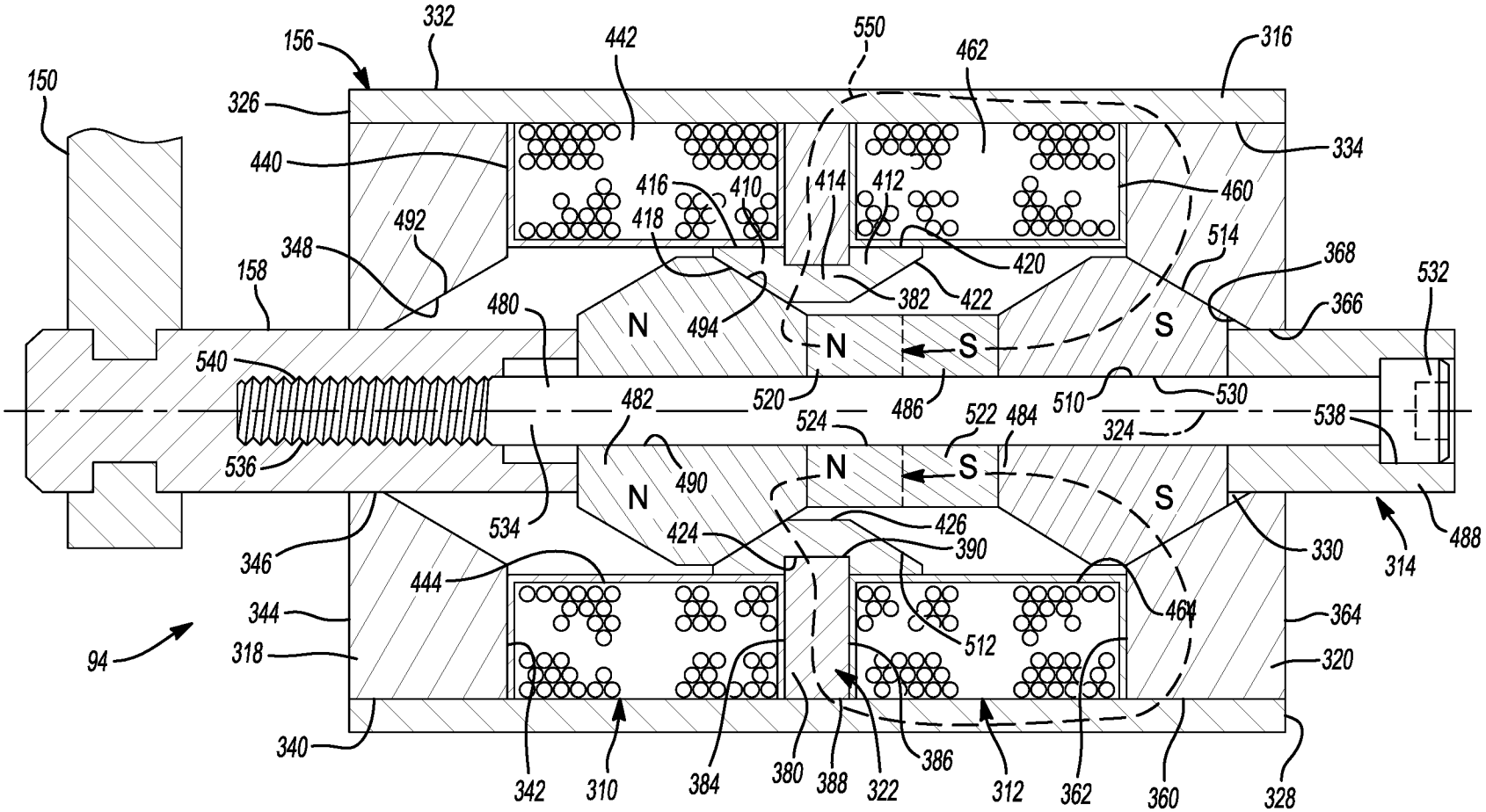
FIG. 5 is a cross-sectional view of the portion of the clutched device of FIG. 4, illustrating the plunger in a second actuator position and the electromagnet in an un-energized state.

With additional reference to FIGS. 3-5, the disconnect actuator 94 can be a self-contained power-operated unit that can include the housing 156, the plunger 158, a first electromagnet 310, a second electromagnet 312, and a core assembly 314. The housing 156 can include an outer case 316, a first pole piece 318, a second pole piece 320, and a central pole piece 322. The outer case 316 can be a generally cylindrical shape disposed about a central axis 324. The outer case 316 can have a first end 326 and a second end 328, and can define a central cavity 330 extending between the first and second ends 326, 328. In the example provided, the outer case 316 is a round cylinder having an outer radial surface 332 and an inner radial surface 334, though other configurations can be used. The inner radial surface 334 can define the central cavity 330. In the example provided the outer case 316 is formed of a mild steel material, though other magnetic materials can be used. The first pole piece 318 can cap the first end 326 of the outer case 316 and the second pole piece 320 can cap the second end 328 of the outer case 316. In the example provided, the first and second pole pieces 318, 320 are formed of a mild steel material, though other magnetic materials can be used.

The first pole piece 318 can be generally cylindrically shaped having a first outer radial surface 340, a first inner side 342, and a first outer side 344, and can define a plunger aperture 346. The plunger aperture 346 can penetrate axially through the first pole piece 318 from the first inner side 342 to the first outer side 344. The plunger 158 can be slidably received through the plunger aperture 346. The first pole piece 318 can be fixedly coupled to the outer case 316. In the example provided, the first pole piece 318 is a cylindrical body received in the central cavity 330 at the first end 326 of the outer case 316. The first outer radial surface 340 can abut and contact the inner radial surface 334 of the outer case 316. While the first pole piece 318 is shown as a separate piece from the outer case 316, the first pole piece 318 can alternatively be unitarily formed with the outer case 316. The first inner side 342 can have a first docking surface 348. In the example provided, the first docking surface 348 is an angled, or frustoconical surface formed coaxially about the axis 324 that converges toward the first outer side 344 and plunger aperture 346. The first docking surface 348 can diverge and open into the central cavity 330 proximate to the first inner side 342.

The second pole piece 320 can be generally cylindrically shaped having a second outer radial surface 360, a second inner side 362, and a second outer side 364. The second pole piece 320 can also define a core aperture 366. The core aperture 366 can penetrate through the second pole piece 320 from the second inner side 362 to the second outer side 364, though other configurations can be used. The second pole piece 320 can be fixedly coupled to the outer case 316. In the example provided, the second pole piece 320 is a cylindrical body received in the central cavity 330 at the second end 328 of the outer case 316. The second outer radial surface 360 can abut and contact the inner radial surface 334 of the outer case 316. While the second pole piece 320 is shown as a separate piece from the outer case 316, the second pole piece 320 can alternatively be unitarily formed with the outer case 316. The second inner side 362 can have a second docking surface 368. In the example provided, the second docking surface 368 is an angled, or frustoconical surface formed coaxially about the axis 324 that converges toward the second outer side 364 and core aperture 366. The second docking surface 368 can diverge and open into the central cavity 330 proximate to the second inner side 362.

The central pole piece 322 can include a central body 380 and a bridge body 382. The central pole piece 322 can be received in the central cavity 330 and spaced apart from the first and second pole pieces 318, 320. The central body 380 can be generally ring shaped having a first side 384, a second side 386, and an outer radial surface 388 that can abut and contact the inner radial surface 334 of the outer case 316. The central body 380 can extend radially inward from the inner radial surface 334 of the outer case 316 to an inner surface 390 distal to the inner radial surface 334. The inner surface 390 can be parallel to the axis 324 and the inner radial surface 334. The first side 384 can face toward the first end 326 of the outer case 316 and the second side 386 can face toward the second end 328 of the outer case 316. The central body 380 can be formed of a mild steel, though other magnetic materials can be used.

The bridge body 382 can be generally ring shaped and can have a first base 410, a second base 412, and a span 414 extending between the first and second bases 410, 412. The first base 410 can be axially between the first side 384 of the central body 380 and the first inner side 342 of the first pole piece 318. The first base 410 can have a first base surface 416 and a third docking surface 418. The first base surface 416 can face radially outward and be concentric with and radially spaced apart from the inner radial surface 334 of the outer case 316. The third docking surface 418 can be an angled, or frustoconical surface formed coaxially about the axis 324 that converges toward the span 414 and the second end 328. The third docking surface 418 can diverge and open toward the first end 326. The second base 412 can be axially between the second side 386 of the central body 380 and the second inner side 362 of the second pole piece 320. The second base 412 can have a second base surface 420 and a fourth docking surface 422. The second base surface 420 can face radially outward and be concentric with and radially spaced apart from the inner radial surface 334 of the outer case 316. The fourth docking surface 422 can be an angled, or frustoconical surface formed coaxially about the axis 324 that converges toward the span 414 and the first end 326. The fourth docking surface 422 can diverge and open toward the second end 328. The span 414 can be generally ring shaped and coaxial about the axis 324. The span 414 can extend axially between the first base 410 and second base 412 and fixedly couple the first and second bases 410, 412. In the example provided, the first base 410, second base 412, and span 414 are unitarily formed of a single piece of mild steel, though other configurations and magnetic materials can be used. The span 414 can have an outer span surface 424 and define a central span bore 426. The outer span surface 424 can abut and contact the inner surface 390 of the central body 380. The first base surface 416 and second base surface 420 can be radially outward of the outer span surface 424 such that the first and second bases 410, 412 can radially overlap a portion of the central body 380 to limit axial movement of the bridge body 382 relative to the central body 380.

The first electromagnet 310 can be received within the central cavity 330 and disposed about the axis 324. The first electromagnet 310 can include a first coil housing 440 and a plurality of first coils 442 disposed within the first coil housing 440 and wound about the axis 324 such that application of a first voltage across the first coils 442 can cause an electrical current to flow through the first coils 442 to produce a magnetic field (not shown) about the axis 324. The first coils 442 can be configured to produce a magnetic field (not shown) having a first polarity when a positive voltage is applied across the first coils 442 (i.e. current flows through the first coils 442 in a first direction), and to produce a magnetic field (not shown) having a second, opposite polarity when a negative voltage is applied across the first coils 442 (i.e. current flows through the first coils 442 in an opposite direction). The first coil housing 440 can abut and contact the inner radial surface 334 of the outer case 316, the first inner side 342 of the first pole piece 318, the first side 384 of the central body 380, and the first base surface 416 of the bridge body 382. The first coil housing 440 can be formed of a non-magnetic material, such as brass or a plastic for example. The first base surface 416 can abut and contact an inner surface 444 of the first coil housing 440 to overlap with at least some of the first coils 442.

The second electromagnet 312 can be received within the central cavity 330 and disposed about the axis 324. The second electromagnet 312 can be axially spaced apart from the first electromagnet 310 by the central body 380 of the central pole piece 322. The second electromagnet 312 can include a second coil housing 460 and a plurality of second coils 462 disposed within the second coil housing 460 and wound about the axis 324 such that application of a first voltage across the second coils 462 can cause an electrical current to flow through the second coils 462 to produce a magnetic field (not shown) about the axis 324. The second coils 462 can be configured to produce a magnetic field (not shown) having a third polarity when a positive voltage is applied across the second coils 462 (i.e. current flows through the second coils 462 in the first direction), and to produce a magnetic field (not shown) having a fourth, opposite polarity when a negative voltage is applied across the second coils 462 (i.e. current flows through the second coils 462 in an opposite direction). The second coil housing 460 can abut and contact the inner radial surface 334 of the outer case 316, the second inner side 362 of the second pole piece 320, the second side 386 of the central body 380, and the second base surface 420 of the bridge body 382. The second coil housing 460 can be formed of a non-magnetic material, such as brass, or a plastic for example. The second base surface 420 can abut and contact an inner surface 464 of the second coil housing 460 to overlap with at least some of the second coils 462.

The first and second coils 442, 462 can be configured such that the first and third polarities produce like poles proximate to the central body 380. For example, when current flows through the first and second coils 462, the positive (or north) poles of the first and second coils 442, 462 can be proximate to the central body 380 while the negative (or south) poles can be proximate to the first and second pole pieces 318, 320 respectively. Likewise, the second and fourth polarities can produce opposite poles such that the negative (or south) poles of the first and second coils 442, 462 can be proximate to the central body 380 while the positive (or north) poles can be proximate to the first and second pole pieces 318, 320 respectively.

The core assembly 314 can be received in the central cavity 330 and can be axially translatable between a first actuator position (FIGS. 3 and 4) and a second actuator position (FIG. 5). In the example provided, the first actuator position corresponds to the first mode position and the second actuator position corresponds to the second mode position. The core assembly 314 can include a central rod 480, a first core block 482, a second core block 484, and a permanent magnet 486. The core assembly 314 can include a core end block 488. The central rod 480, first core block 482, second core block 484, and permanent magnet 486 can be fixedly coupled for common axial translation. The first core block 482 can be disposed about the axis 324, can define a central bore 490, and can have a first mating surface 492 and a third mating surface 494. The first mating surface 492 can be generally frustoconical in shape such that the first mating surface 492 radially overlaps with the first docking surface 348. The first mating surface 492 and first docking surface 348 can be formed at similar angles such that the first mating surface 492 is configured to oppose or matingly engage and contact the first docking surface 348. In the example provided, the first mating surface 492 and first docking surface 248 are formed at an angle greater than 0° and less than 90°. The third mating surface 494 can be generally frustoconical in shape such that the third mating surface 494 radially overlaps with the third docking surface 418. The third mating surface 494 and third docking surface 418 can be formed at similar angles such that the third mating surface 494 is configured to oppose or matingly engage and contact the third docking surface 418. In the example provided, the third mating surface 494 and third docking surface 418 are formed at an angle greater than 0° and less than 90°. The first core block 482 can be formed of a mild steel, though other magnetic materials can be used.

The second core block 484 can be disposed about the axis 324, can define a central bore 510, and can have a second mating surface 512 and a fourth mating surface 514. The second mating surface 512 can be generally frustoconical in shape such that the second mating surface 512 radially overlaps with the second docking surface 368. The second mating surface 512 and second docking surface 368 can be formed at similar angles such that the second mating surface 512 is configured to oppose or matingly engage and contact the second docking surface 368. In the example provided, the second mating surface 512 and second docking surface 368 are formed at an angle greater than 0° and less than 90°. The fourth mating surface 514 can be generally frustoconical in shape such that the fourth mating surface 514 radially overlaps with the fourth docking surface 422. The fourth mating surface 514 and fourth docking surface 422 can be formed at similar angles such that the fourth mating surface 514 is configured to oppose or matingly engage and contact the fourth docking surface 422. In the example provided, the fourth mating surface 514 and fourth docking surface 422 are formed at an angle greater than 0° and less than 90°. The second core block 484 can be formed of a mild steel, though other magnetic materials can be used.

The permanent magnet 486 can be a generally cylindrical shape formed of a permanently polarized material having a positive (or north) pole 520 and a negative (or south) pole 522 facing axially opposite ends 326, 328. In the example provided, the north pole is proximate to the first end 326 and the south pole is proximate to the second end 328, though other configurations can be used. The permanent magnet 486 can define a central bore 524 and be disposed about the axis 324 axially between the first and second core blocks 482, 484. The permanent magnet 486 can abut and contact the first and second core blocks 482, 484 and be spaced apart and radially inward of the bridge body 382. The permanent magnet can have a magnetic field (not shown) of a strength sufficient to hold the core assembly 314 in the first and second actuator positions when the first and second electromagnets 310, 312 are unenergized, as will be discussed below.

The core end block 488 can be a generally cylindrical shape defining a central bore 530. The core end block 488 can be received in the central cavity 330 and can be axially slidingly received in the core aperture 366. The central rod 480 can be received through the central bores 490, 510, 524, 530 of the first core block 482, second core block 484, the permanent magnet 486, and core end block 488. The central rod 480 can couple the first core block 482, second core block 484, the permanent magnet 486, core end block 488, and plunger 158 together for common axial translation along the axis 324. In the example provided, the central rod 480 is a bolt having a head 532, a body 534 and a plurality of threads 536, though other configurations can be used. The central bore 530 of the core end block 488 can have a counter bore 538 in which the head is received, and the plunger 158 can have a plurality of mating threads 540 with which the plurality of threads 536 can engage, in order to retain the first core block 482, second core block 484, and permanent magnet 486 between the plunger 158 and the core end block 488 for common axial translation.

In operation, the core assembly 314 can be configured to axially translate the plunger 158 which can move the shift fork 150 to translate the shift collar 142 between the first and second mode positions when the core assembly 314 translates between the first and second actuator positions. With specific reference to FIG. 3, the core assembly 314 is shown in the first actuator position with the first and second electromagnets 310, 312 in an unenergized state, wherein current does not flow through the first and second coils 442, 462 to generate a magnetic field (not shown). In this configuration, the permanent magnet polarizes the first and second core blocks 482, 484 (positive polarity indicated by "N", negative polarity indicated by "S") and generates a magnetic flux 550 that can flow through the housing 156 as shown. Specifically, the magnetic flux 550 can flow from the north pole 520, through the first core block 482, to the first pole piece 318, to the outer case 316, to the central body 380, to the second base 412, through the second core block 484 and to the south pole 522 of the permanent magnet 486. This magnetic flux 550 can hold the core assembly 314 in the first actuator position without the need for continuous power to be provided to the actuator 94.

With specific reference to FIG. 4, the core assembly 314 is shown in the first actuator position with the first and second electromagnets 310, 312 in a first energized state, wherein current flows through the first and second coils 442, 462 in the first direction to generate a first magnetic field (not shown). In this configuration, the magnetic field generated by the first and second electromagnets 310, 312 can polarize the first and second pole pieces 318, 320 with the same polarity, and can polarize the central pole piece 322 with a polarity opposite the first and second pole pieces 318, 320 (positive polarity indicated by "N", negative polarity indicated by "S"). In this configuration, since the first core block 482 is positively polarized by the permanent magnet 486, and the first pole piece 318 is positively polarized by the first electromagnet 310, the first pole piece 318 and the first core block 482 are repelled from one another to urge the core assembly 314 axially in the direction away from the first end 326 and toward the second actuator position. Likewise, since the central pole piece 322 is negatively polarized by the first and second electromagnets 310, 312 and the second core block 484 is negatively polarized by the permanent magnet 486, the central pole piece 322 and the second core block 484 are repelled from one another to also urge the core assembly 314 axially in the direction away from the first end 326. Since the central pole piece 322 is negatively polarized and the first core block 482 is positively polarized, the first core block 482 is attracted to the central pole piece 322 to urge the first core block 482 toward the central pole piece 322. Likewise, since the second pole piece 320 is positively polarized and the second core block 484 is negatively polarized, the second core block 484 is attracted to the second pole piece 320 to urge the core assembly 314 toward the second end 328. These attractive and repulsive magnetic forces can move the core assembly 314 to the second actuator position.

With specific reference to FIG. 5, the core assembly 314 is shown in the second actuator position with the first and second electromagnets 310, 312 in the unenergized state, wherein current does not flow through the first and second coils 442, 462 to generate a magnetic field (not shown). In this configuration, the permanent magnet polarizes the first and second core blocks 482, 484 (positive polarity indicated by "N", negative polarity indicated by "S") and generates a magnetic flux 560 that can flow through the housing 156 as shown. Specifically, the magnetic flux 560 can flow from the north pole 520, through the first core block 482, to the first base 410, to the central body 380, to the outer case 316, to the second pole piece 320, through the second core block 484 and to the south pole 522 of the permanent magnet 486. This magnetic flux 560 can hold the core assembly 314 in the second actuator position without the need for continuous power to be provided to the actuator 94. Thus, once the core assembly 314 is in the second actuator position, power to the actuator 94 can be shut off, while maintaining the actuator 94 in the second actuator position. It is appreciated that the actuator 94 can be configured such that power could be cut off before the core assembly 314 fully reaches the second actuator position. In such a configuration, power could be cut off when the core assembly 314 reaches a position such that the magnetic field produced by the permanent magnet is sufficient to attract the core assembly 314 the remaining distance toward the second actuator position. To move the core assembly 314 from the second actuator position to the first actuator position, the current in the first and second coils 462 can be reversed to negatively polarize first and second pole pieces 318, 320 and positively polarize the central pole piece 322 to reverse the process and move the core assembly 314 axially toward the first end 326.

Figure 6:
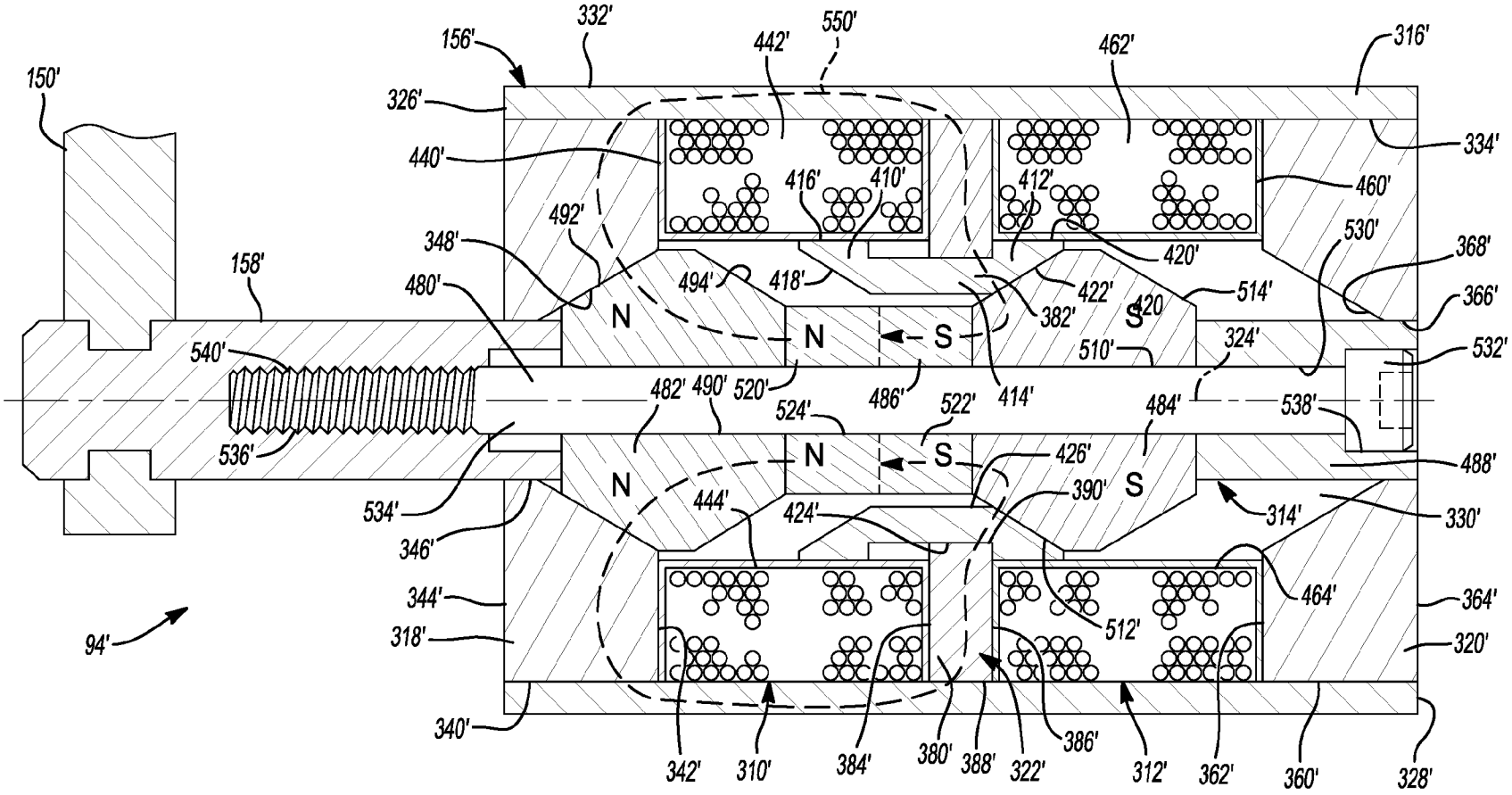
FIG. 6 is a cross-sectional view of a portion of the clutched device of FIG. 1, illustrating an actuator of the clutched device of a second construction in more detail.
Figure 7:
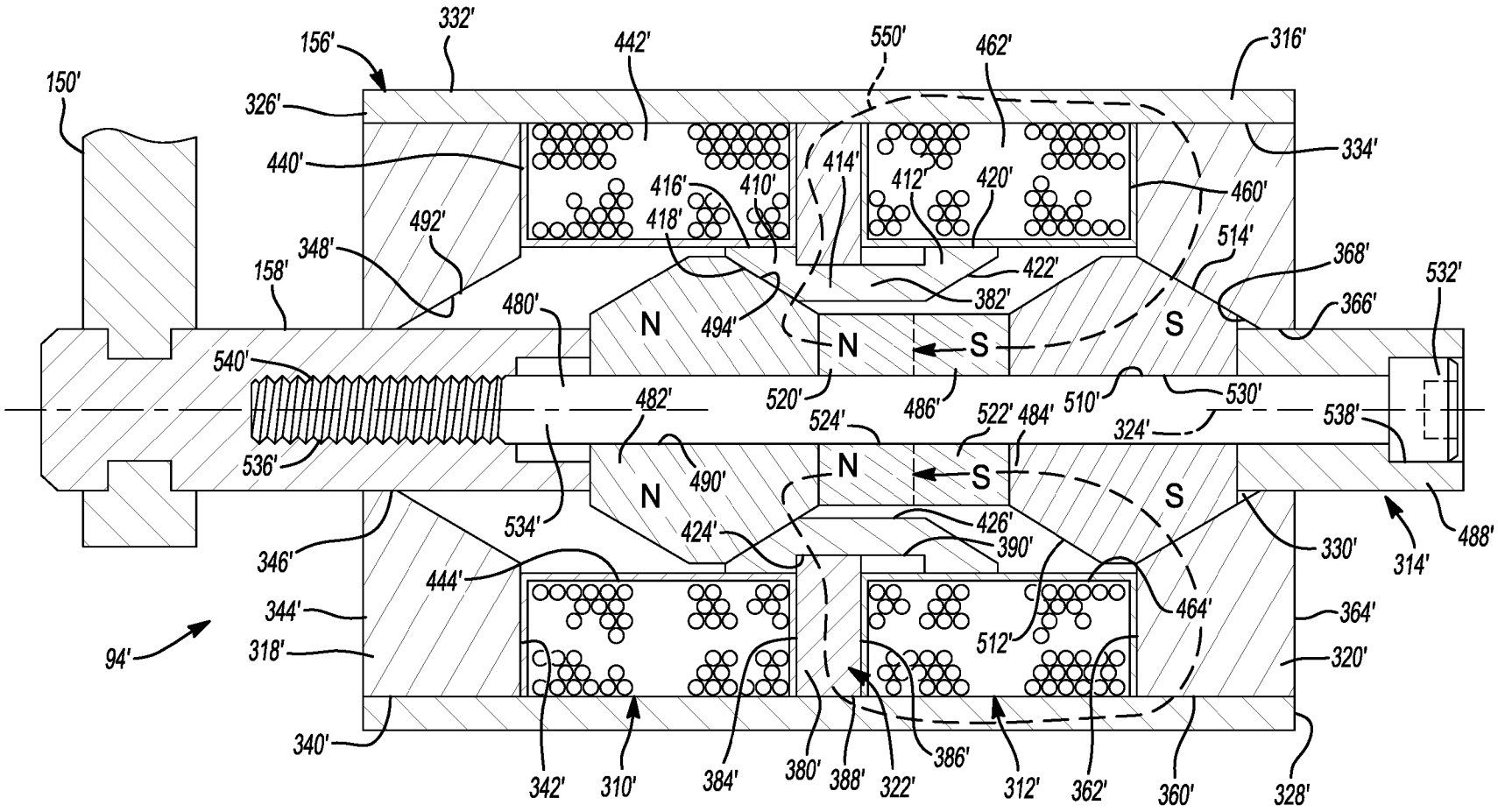
FIG. 7 is a cross-sectional view of the portion of the clutched device of FIG. 6, illustrating a plunger of the actuator in a second actuator position and an electromagnet of the actuator in an un-energized state.

With reference to FIGS. 6 and 7, an actuator 94' of a second construction is illustrated. The actuator 94' is similar to actuator 94 and similar features are represented by primed reference numerals. Accordingly, the discussion of the similar features from actuator 94 and vehicle 10 is incorporated herein by reference and only differences will be discussed in detail. The bridge body 382' of the actuator 94' can differ from the bridge body 382 in that the span 414' can be axially longer than the span 414 and axially longer than the central body 380' is thick (i.e. the thickness between the first side 384' and second side 386' of the central body 380'). When the core assembly 314' is in the first actuator position (FIG. 6), the magnetic flux 550' can cause the second core block 484' to hold the second base 412' against the second side 386' of the central body 380'. In this construction, the longer span 414' causes the first base 410' to extend axially toward the first end 326' more than the second base 412' extends axially toward the second end 328', but while still being spaced apart from the first core block 482'. When the first and second electromagnets 310', 312' are energized, the negatively polarized first base 410' of the bridge body 382' is closer to the positively charged first core block 482'. The increased proximity of the first base 410' to the first core block 482' can increase the attractive force therebetween when the first electromagnet 310' is energized to cause the actuator 94' to move from the first actuator position to the second actuator position (FIG. 7) more quickly.

When the core assembly 314' moves from the first actuator position to the second actuator position, the first core block 482' pushes the bridge body 382' in the axial direction toward the second end 328' to cause the bridge body 382' to slide axially relative to the central body 380'. The bridge body 382' can slide axially relative to the central body 380' until the first base 410' contacts the first side 384' of the central body 380'. The first base 410' can contact the first side 384' when the core assembly 314' is in the second actuator position and the second mating surface 512' of the second core block 484' contacts the second docking surface 368' of the second pole piece 320'. In the second actuator position, the longer span 414' causes the second base 412' to then extend axially toward the second end 328' similarly to the first base 410' when the core assembly 314' is in the first actuator position. This proximity of the second base 412' to the second core block 484' operates similarly when reversing the current in the first and second electromagnets 310', 312' to move the core assembly 314' from the second actuator position to the first actuator position.

Similarly, when the core assembly 314' moves from the second actuator position to the first actuator position, the second core block 484' pushes the bridge body 382' in the axial direction toward the first end 326' to cause the bridge body 382' to slide axially relative to the central body 380'. The bridge body 382' can slide axially relative to the central body 380' until the second base 412' contacts the second side 386' of the central body 380'. The second base 412' can contact the second side 386' when the core assembly 314' is in the first actuator position and the first mating surface 492' of the first core block 482' contacts the first docking surface 348' of the first pole piece 318'.

Figure 8:
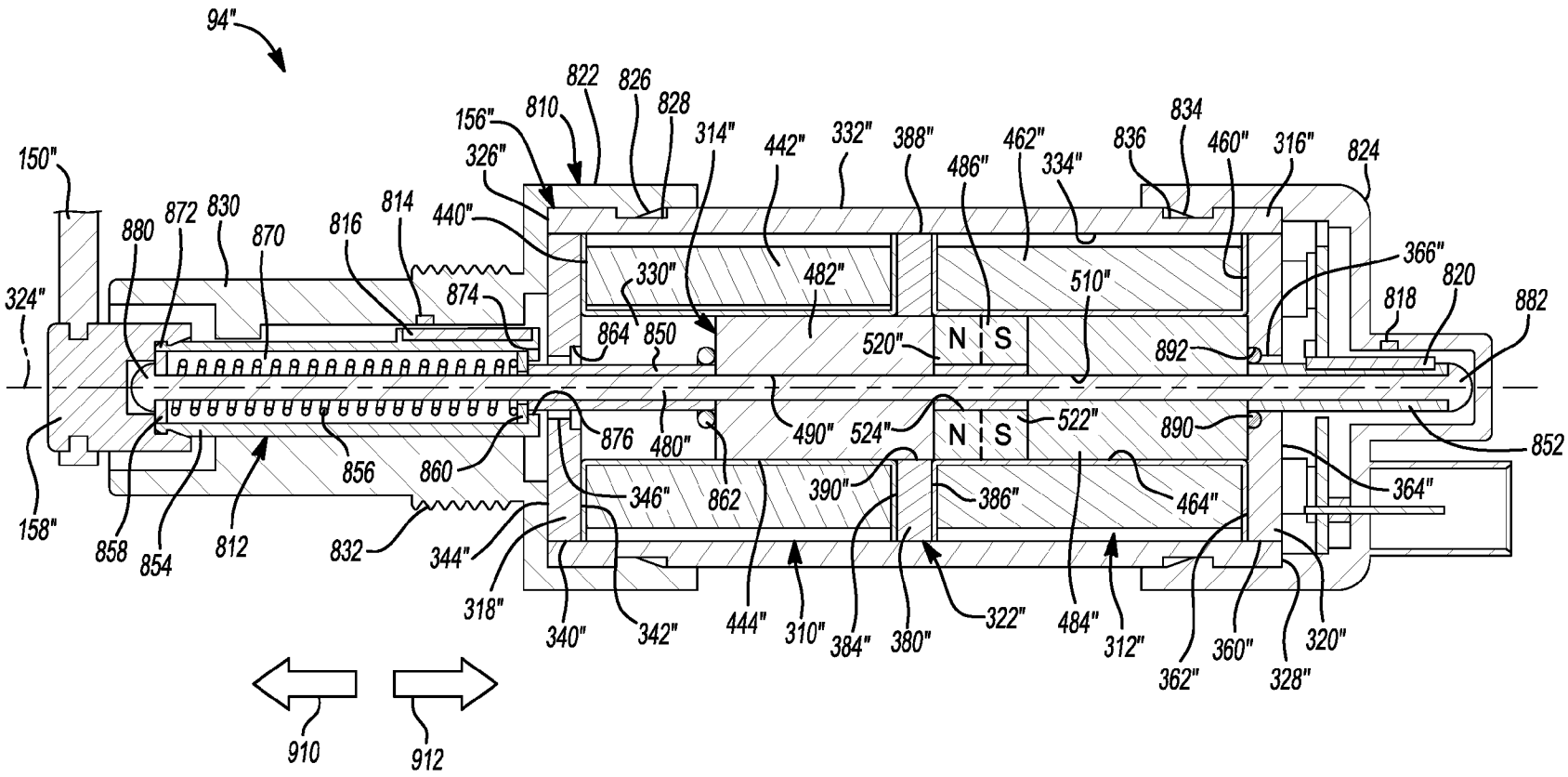
FIG. 8 is a cross-sectional view of a portion of the clutched device of FIG. 1, illustrating an actuator of the clutched device of a third construction in more detail.

With additional reference to FIG. 8, an actuator 94" of a third construction is illustrated. The actuator 94" can be constructed in a similar manner as the actuator 94 with similar features represented by double primed reference numerals. Accordingly, the discussion of the similar features from actuator 94 and vehicle 10 is incorporated herein by reference and only differences will be discussed in detail. The actuator 94" can further include an outer housing 810, an axial compliance mechanism 812, a first sensor 814, a first target 816, a second sensor 818, and a second target 820. In this construction, the central rod 480" is not fixedly coupled to the first and second core blocks 482", 484", or the permanent magnet 486". In contrast, the central rod 480" is separate from the core assembly 314", which includes the permanent magnet 486", and the first and second core blocks 482", 484". The central rod 480" is coaxial with the core assembly 314" and axially slidable relative to the core assembly 314".

The outer housing 810 can include a first shell 822 and second shell 824. The first shell 822 can cap the first outer side 344" of the first pole piece 318" and can be partially disposed about the outer case 316", such that the first end 326" is received within the first shell 822. The first shell 822 can be coupled to the outer case 316 to inhibit axial separation therefrom. In the example provided, the first shell 822 includes at least one clip 826 that is received in an indention 828 formed in the outer radial surface 332" of the outer case 316" to couple the first shell 822 to the outer case 316. The first shell 822 can include a nose portion 830 that extends axially away from the first pole piece 318". The nose portion 830 can include a plurality of external threads 832 that can be configured to mount the actuator 94" to the vehicle 10, such as to the housing 74 of the PTU 26 (FIG. 2). The nose portion 830 can be a generally tubular body, within which the central rod 480" can extend.

The second shell 824 can cap the second outer side 364" of the second pole piece 320" and can be partially disposed about the outer case 316", such that the second end 328" is received within the second shell 824. The second shell 824 can be coupled to the outer case 316 to inhibit axial separation therefrom. In the example provided, the second shell 824 includes at least one clip 834 that is received in an indention 836 formed in the outer radial surface 332" of the outer case 316" to couple the second shell 824 to the outer case 316.

The axial compliance mechanism 812 can include a first shaft or sleeve 850, a second shaft or sleeve 852, a tube 854, a spring 856, a first annular plate 858, and a second annular plate 860. The first sleeve 850, first and second annular plates 858, 860, spring 856, and tube 854 can be disposed coaxially about the central rod 480" between the first core block 482" and the shift fork 150". The first sleeve 850 can be axially between the first core block 482" and the second annular plate 860, and can contact the first core block 482" and the second annular plate 860. The first sleeve 850 can be received through the plunger aperture 346". A first bumper 862 can be disposed about the first sleeve 850, axially between the first pole piece 318" and the first core block 482". In the example provided, the first bumper 862 is a resilient O-ring configured to be received within a bore 864 defined by the first pole piece 318" and to dampen an impact of the first core block 482" with the first pole piece 318.

The tube 854 can be axially slidable within the nose portion 830 of the outer housing 810 and can define a spring chamber 870. A first end 872 of the tube 854 can be fixedly coupled to the plunger 158" for common axial translation. A second end 874 of the tube 854 that is proximate to the first pole piece 318" can define a bore 876 that has a diameter that is less than the diameter of the spring chamber 870. The first sleeve 850 can be slidably received through the bore 876.

The first annular plate 858 can have an inner diameter greater than the central rod 480" and an outer diameter less than the spring chamber 870, such that the first annular plate 858 is received in the spring chamber 870 about the central rod 480". The second annular plate 860 can have an inner diameter greater than the central rod 480" and an outer diameter less than the spring chamber 870, such that the can be received in the spring chamber 870 about the central rod 480". The outer diameter of the second annular plate 860 can be greater than the bore 876 and the inner diameter of the second annular plate 860 can be less than the bore 876 and the first sleeve 850. The second annular plate 860 can be axially between the first annular plate 858 and the first sleeve 850.

The spring 856 can be a coil spring disposed concentrically about the central rod 480" within the spring chamber 870. The spring 856 can be disposed axially between the first and second annular plates 858, 860. The spring 856 can have a diameter greater than the inner diameters and less than the outer diameters of the first and second annular plates 858, 860.

Each end of the central rod 480" can include an end cap 880, 882 that extends radially outward from the rest of the central rod 480". The end cap 880 that is proximate to the plunger 158", can have a diameter that is greater than the inner diameter of the first annular plate 858 and less than the spring chamber 870. In this way, the end cap 880 and the second end 874 of the tube 854 can retain the spring 856 and first and second annular plates 858, 860 within the spring chamber 870.

The second sleeve 852 can be disposed coaxially about the central rod 480". The second sleeve 852 can be axially between and can contact the second core block 484" and the other end cap 882. The second sleeve 852 can be received through the core aperture 346". The other end cap 882 can have a diameter that is greater than the diameter of the second sleeve 852, such that the other end cap 882 can retain the second sleeve about the central rod 480". A second bumper 890 can be disposed about the second sleeve 852, generally axially between the second pole piece 320" and the second core block 484". In the example provided, the second bumper 890 is a resilient O-ring configured to be received within a bore 892 defined by the second pole piece 320" and to dampen an impact of the second core block 484" with the second pole piece 320.

The first target 816 can be fixedly coupled to the tube 854 for common axial translation therewith. The first sensor 814 can be disposed within the nose portion 830 and configured to detect the axial position of the first target 816. The first sensor 814 can be one of the sensors within the group of first sensors 198 (FIG. 1). The first sensor 814 and first target 816 can be any suitable type of sensor and target, such as a magnet and a hall effect sensor for example.

The second target can be fixedly coupled to the second sleeve 852 for common axial translation therewith. The second sensor 818 can be disposed within the second shell 824 and configured to detect the axial position of the second target 820. The second sensor 818 can be one of the sensors within the group of first sensors 198 (FIG. 1). The second sensor 818 and second target 820 can be any suitable type of sensor and target, such as a magnet and a hall effect sensor for example.

In general, the axial compliance mechanism 812 can transmit linear motion of the permanent magnet 486" to linear motion of the plunger 158", while permitting relative movement between the plunger 158" and the permanent magnet 486" in both axial directions. For example, if the internal spline teeth 146 of the shift collar 142 are blocked by the external clutch teeth 138 of the transfer shaft 110 (FIG. 2), or are torque locked thereto, then the axial compliance mechanism 812 can permit the core assembly 314" to still move axially between the first and second pole pieces 318", 320". The axial compliance mechanism 812 can then bias the plunger 158" toward the first actuator position when the permanent magnet 486" magnetically couples the first core block 482" to the first pole piece 318", and can bias the plunger 158" toward the second actuator position when the permanent magnet 486" magnetically couples the second core block 484" to the second pole piece 320".

In operation, when the first and second electromagnets 310", 312" are energized to repel the core assembly 314" from the second pole piece 320" and attract the core assembly 314" toward the first pole piece 318", the core assembly 314" moves axially in a first direction 910. The first core block 482" pushes the first sleeve 850 axially in the first direction 910. The first sleeve 850 pushes the second annular plate 860 axially in the first direction 910. When the internal spline teeth 146 of the shift collar 142 are blocked by the external clutch teeth 138 of the transfer shaft 110 (FIG. 2), the plunger 154" is prevented from moving in the first direction 910. Thus, the second annular plate 860 compresses the spring 856 within the tube 854 to bias the central rod 480" and the plunger 158" in the first direction 910. The force of the spring 856 can be insufficient to overcome the magnetic coupling of the first core block 482" to the first pole piece 318", such that power does not need to be maintained to the first and second electromagnets 310", 312". When the shift collar 142 is no longer blocked, the spring 856 can then move the plunger 158" in the first direction 910.

When the first and second electromagnets 310", 312" are energized to repel the core assembly 314" from the first pole piece 318" and attract the core assembly 314" toward the second pole piece 320", the core assembly 314" moves axially in a second direction 912. The second core block 484" pushes the second sleeve 852 axially in the second direction 912. The second sleeve 852 engages the other end cap 882 to push the central rod 480" axially in the second direction 912. When the shift collar 142 and the transfer shaft 110 (FIG. 2) are torque locked, the plunger 154" is prevented from moving in the second direction 912. Thus, the end cap 880 causes the first annular plate 858 to compress the spring 856 within the tube 854 to bias the plunger 158" in the second direction 912. The force of the spring 856 can be insufficient to overcome the magnetic coupling of the second core block 484" to the second pole piece 320", such that power does not need to be maintained to the first and second electromagnets 310", 312". When the shift collar 142 is no longer torque locked, the spring 856 can then move the plunger 158" in the second direction 912.

Since the first target 816 moves axially with the tube 854 and plunger 158", the first sensor 814 can detect the position of the plunger 158", and thus the position of the shift fork 150". In this way, the first sensor 814 can detect if the shift collar 142 (FIG. 2) is in the first mode position, the second mode position, or blocked in a position therebetween.

Since the second target 820 moves with the second sleeve 852, which moves axially with the core assembly 314", the second sensor 818 can detect the position of the core assembly 314". In this way, the second sensor 818 can detect if the core assembly 314" is in the first actuator position, the second actuator position, or some other position therebetween. The combination of the first and second sensors 814, 818 can allow for an independent determination of the condition or position of the actuator 94" and shift collar 142.

It is understood that the axial compliance mechanism 812 and/or the first and second sensors 814, 818 can also be incorporated into the actuators (94, 94') of the first and second constructions, described above with reference to FIGS. 3-7.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. An actuator comprising:

a housing having a first pole piece, a second pole piece, and a central pole piece disposed between the first and second pole pieces, the central pole piece having a central body and a bridge, the bridge having a first base, a second base, and a span that extends between the first and second bases;

a core assembly received in the housing and being movable relative to the bridge along a first axis between a first core position and a second core position, the core assembly including a permanent magnet, and first and second cores coupled for common axial movement with the permanent magnet, the first and second cores being spaced axially apart along the first axis by the permanent magnet; and first and second electromagnets that are spaced axially apart by the central pole piece, the first and second electromagnets having opposite polarities;

wherein the bridge extends radially inward of an outermost portion of the first core and radially inward of an outer most portion of the second core, and the central body is axially between the first and second electromagnets; and wherein the first base is radially inward of the first electromagnet and axially overlaps with a portion of the first electromagnet, and the second base is radially inward of the second electromagnet and axially overlaps with a portion of the second electromagnet.

2. The actuator of claim 1, further comprising a plunger and a spring, the plunger being axially movable relative to the core assembly between a first plunger position and a second plunger position, wherein the spring is configured to bias the plunger toward the first plunger position when the core assembly is in the first core position, and wherein the spring is configured to bias the plunger toward the second plunger position when the core assembly is in the second core position.

3. The actuator of claim 2, further comprising a rod member and a tube, the rod member being disposed about the first axis and slidably received through a central aperture of the core assembly, the tube being fixedly coupled to the plunger for common translation with the plunger and surrounding the spring and a portion of the rod member.

4. The actuator of claim 2, further comprising a first element, a second element, a first sensor, a first target, a second sensor, and a second target, wherein the first element and second elements are axially fixed relative to the housing, wherein one of the first sensor and first target is coupled to the plunger for common axial translation with the plunger, and the other of the first sensor and first target is coupled to the first element, wherein one of the second sensor and second target is coupled to the core assembly for common axial translation with the core assembly, and the other of the second sensor and second target is coupled to the second element.

5. The actuator of claim 1, wherein the housing further includes a case radially outward of the first and second electromagnets, and wherein the first and second cores, the first and second pole pieces, the central pole piece, and the case are formed of ferromagnetic materials.

6. The actuator of claim 1, wherein the bridge is slidable relative to the central body between a first bridge position and a second bridge position.

7. The actuator of claim 6, wherein when the bridge is in the first bridge position, the first base is a first distance from the first pole piece and when the bridge is in the second bridge position, the first base is a second distance from the first pole piece, the second distance being greater than the first distance.

8. An actuator comprising:

a housing having a first pole piece, a second pole piece, and a central pole piece that is disposed between the first and second pole pieces, the central pole piece having a central body and a bridge, the bridge being disposed between the first and second pole pieces and axially movable relative to the first and second pole pieces;

a core assembly received in the housing, the core assembly being movable relative to the bridge along a first axis between a first core position and a second core position, the core assembly including a permanent magnet, a first core, and a second core, the first and second cores being coupled to the permanent magnet for common axial movement; and first and second electromagnets that are spaced axially apart by the central body, the first and second electromagnets having opposite polarities.

9. The actuator of claim 8, wherein the housing further includes a case radially outward of the first and second coils, and wherein the first and second cores, the first and second pole pieces, the central pole piece, and the case are ferromagnetic.

10. The actuator of claim 8, wherein the bridge has a first base, a second base, and a span that extends between the first and second bases, the first base being radially inward of the first coils and axially overlapping with a portion of the first coils, the second base being radially inward of the second coils and axially overlapping with a portion of the second coils.

11. The actuator of claim 10, wherein the bridge is slidable relative to the central body between a first bridge position and a second bridge position, and wherein the first base is a first distance from the first pole piece when the bridge is in the first bridge position, and wherein the first base is a second distance from the first pole piece when the bridge is in the second bridge position, the second distance being greater than the first distance.

12. The actuator of claim 8, further comprising a plunger and a spring, the plunger being movable between a first plunger position and a second plunger position, wherein the spring is configured to bias the plunger toward the first plunger position when the core assembly is in the first core position, and wherein the spring is configured to bias the plunger toward the second plunger position when the core assembly is in the second core position.

13. The actuator of claim 12, further comprising a rod member and a tube, the rod member being disposed about the first axis and slidably received through a central aperture of the core assembly, the tube being fixedly coupled to the plunger for common translation with the plunger and surrounding the spring and a portion of the rod member.

14. The actuator of claim 12, further comprising a first element, a second element, a first sensor, a first target, a second sensor, and a second target, wherein the first element and second elements are axially fixed relative to the housing, wherein one of the first sensor and first target is coupled to the plunger for common axial translation with the plunger, and the other of the first sensor and first target is coupled to the first element, wherein one of the second sensor and second target is coupled to the core assembly for common axial translation with the core assembly, and the other of the second sensor and second target is coupled to the second element.

15. The actuator of claim 1, wherein when the core assembly is in the first core position, the first core contacts the first base and the second core is spaced apart from the second base, and when the core assembly is in the second core position, the first core is spaced apart from the first base and the second core contacts the second base.

16. The actuator of claim 8, wherein when the core assembly is in the first core position, the first core contacts the bridge and the second core is spaced apart from the bridge, and when the core assembly is in the second core position, the first core is spaced apart from the bridge and the second core contacts the bridge.

* * * * *